US005839819A

United States Patent [19]

Pan

[11] Patent Number: 5,839,819

[45] Date of Patent: Nov. 24, 1998

[54] LIGHT BULB HOLDERS FOR A DECORATIVE LIGHT STRING NET

[76] Inventor: Wun Fang Pan, No. 125, Lane 99, Pu Ting Road, Hsinchu, Taiwan

[21] Appl. No.: 889,757

[22] Filed: Jul. 10, 1997

[51] Int. Cl.[6] ..... F21P 1/00

[52] U.S. Cl. ..... 362/252; 362/391; 362/396; 362/806

[58] Field of Search ..... 362/249, 252, 362/806, 396, 391

[56] References Cited

U.S. PATENT DOCUMENTS 5,645,342 7/1997 Chang ..... 362/252
5,697,698 12/1997 Huang ..... 362/806 X

*Primary Examiner*—Stephen F. Husar
*Attorney, Agent, or Firm*—Rosenberg, Klein & Bilker

[57] ABSTRACT

The present invention relates to an improved light bulb holder for a decorative light string net which has a pair of connecting base mounted on its two sides having related outward grooves for engaging with the electrical wires more convenient and easy to form a beautiful decorative light string net.

1 Claim, 3 Drawing Sheets

LIGHT BULB HOLDERS FOR A DECORATIVE LIGHT STRING NET

BACKGROUND OF THE INVENTION

A prior known decorative light string net, as shown in FIG. 1, includes a light bulb holder 2 provided with a ring 1 on its top end. Many bulb holders 2 are connected together to become a decorative light string net by electrical wires 3. While assembly, the prior structure will be very trouble to insert the electrical wires 3 through each ring 1 which is then forcedly mounted on the light holder 2 for obtaining the light string net.

The main objective of the present invention is to provide an improved structure of light bulb holders which have a pair of connecting bases for easily connecting with each electrical wire to become a decorative light string net.

BRIEF DESCRIPTION ACCOMPANYING DRAWINGS

Now the structure and features of the invention will be described below in detailed with reference to the accompanying drawings in which.

DETAILED DESCRIPTION OF A PREFERRED EMBODIMENT

Figure 1:
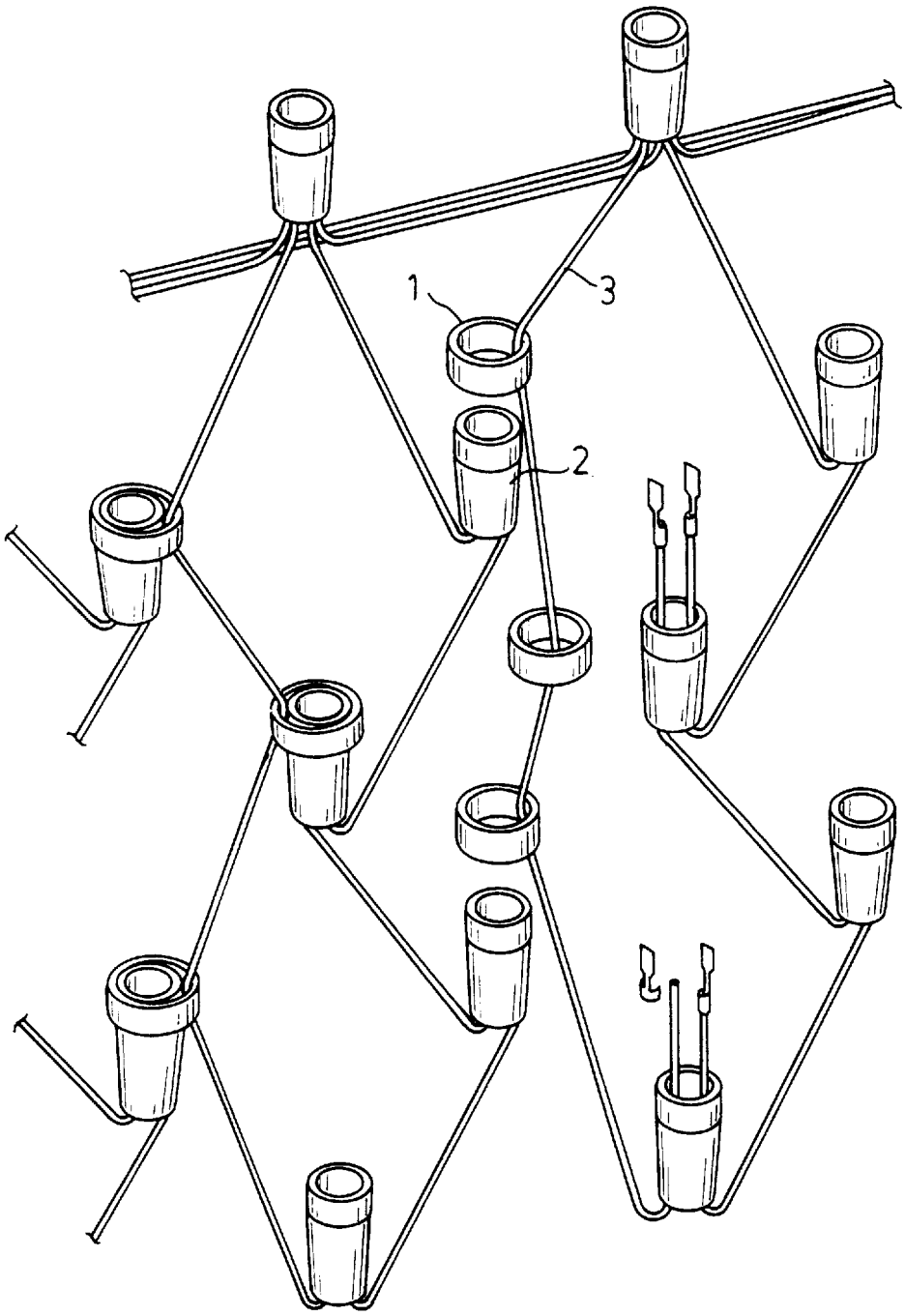
FIG. 1 (prior art)
FIG. 1 is a perspective view of a prior known decorative light string ring.
Figure 2:
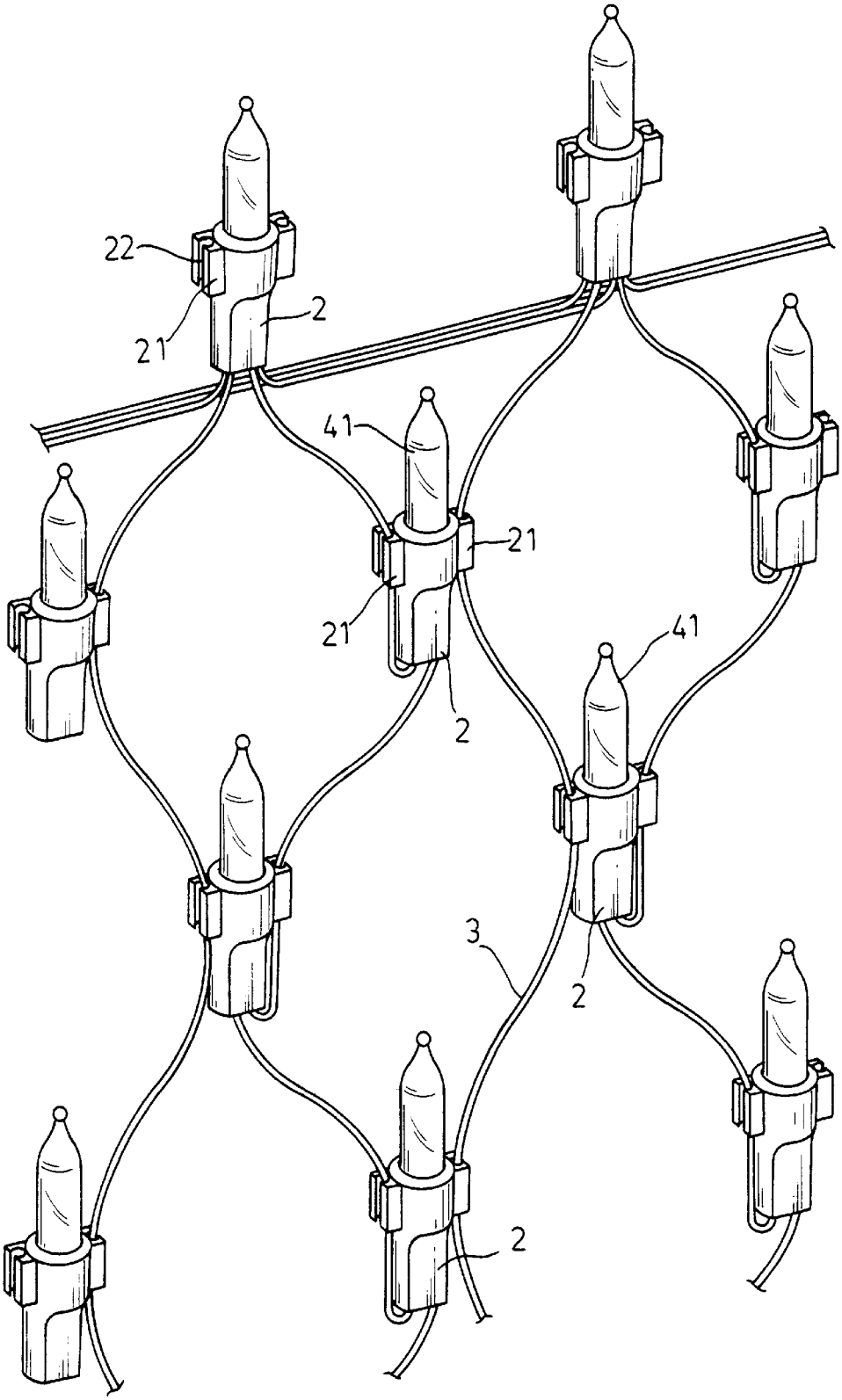
FIG. 2 is a perspective view of a decorative light string ring with improved light bulb holders according to this invention.
Figure 3:
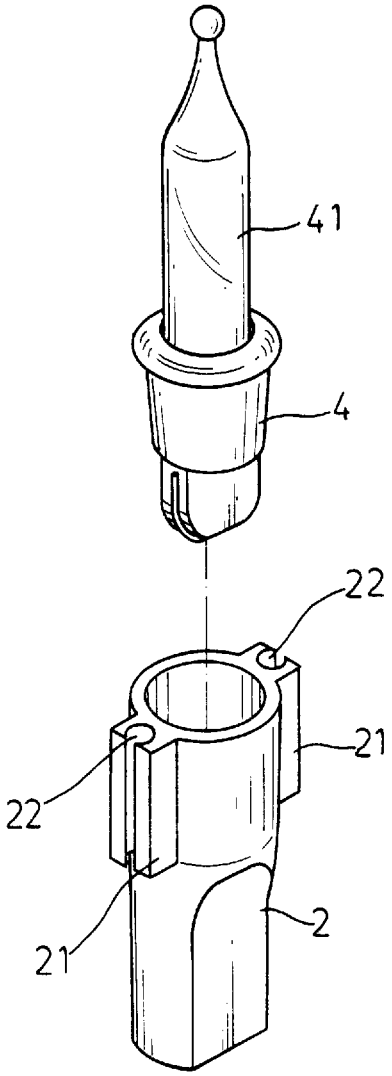
FIG. 3 is an exploded perspective view of a light bulb holder according to the invention.

Now referring to the FIGS. 2 and 3, it can be seen that the present invention includes an improved light bulb holder 2 which has a pair of connecting bases 21 mounted on its two sides. Each of the two connecting bases 21 is provided with an outward groove 22 which is parallel to the axis of the light bulb holder 2 and has a C-type cross section. Since the connecting base 21 is made of plastic, it is somehow flexible. A base 4 engaged with a bulb 41 is received in the light bulb holder 1 as any prior known one. In use, the electrical wire 3 is capable of being pushed into the groove 22 of the connecting base 21 easily. Because of the elastic engagement, the wires 3 are firmly connected within the C-type groove 22 of each light bulb holder 2, as in FIG. 2, to form a beautiful secure decorative light string net.

It will be understood that the present invention can provide an improved structure of light bulb holders for connecting with electrical wires quickly and securely to become a decorative light string net as above mentioned that obviously obtains improvement and makes large progress.

Although this invention has been described in connection with specific forms and embodiments thereof, it is to be understood that all matter herein described or shown in the accompanying drawings is to be interpreted as illustrative and not in a limiting sense. Thus it will be appreciated that the drawings are exemplary of a preferred embodiment of the invention. Various modifications may be made without departing from the scope of the appended claims.

I claim:

1. A light bulb holder for use in a decorative light string net and having an open end for receiving a lamp base therein, said light bulb holder comprising a tubular body and a pair of flexible base members extending from each of two opposing sides thereof, each of said pair of base members being disposed in spaced parallel relationship to define a groove therebetween, each of said pair of base members having an arcuate wall surface disposed in facing relationship one with respect to the other to define a C-shaped cross-sectional contour of said groove for retaining an electrical wire therein.

* * * * *